United States Patent [19]

Nagashima et al.

[11] Patent Number: 4,635,517

[45] Date of Patent: Jan. 13, 1987

[54] ELECTRIC MUSICAL INSTRUMENT

[75] Inventors: Yoichi Nagashima; Tatsunori Kondo; Kiyomi Takauji; Mineo Kitamura, all of Shizuoka, Japan

[73] Assignee: Kabushiki Kaisha Kawai Gakki Seisakusho, Japan

[21] Appl. No.: 679,758

[22] Filed: Dec. 10, 1984

[30] Foreign Application Priority Data

Dec. 10, 1983 [JP] Japan ..... 58-233330

[51] Int. Cl.[4] ..... G10H 1/20; G10H 7/00

[52] U.S. Cl. ..... 84/1.01; 84/1.03; 84/1.28

[58] Field of Search ..... 84/1.01, 445, 451, 1.28, 84/1.03

[56] References Cited

U.S. PATENT DOCUMENTS 4,498,363 2/1985 Shimata et al. ..... 84/451

4,512,230 4/1985 Ezawa et al. ..... 84/1.03

OTHER PUBLICATIONS

Synclavier II Instruction Manual, New England Digital Corporation, 1982, pp. 94–97.

*Primary Examiner*—Arthur T. Grimley

*Assistant Examiner*—David Warren

*Attorney, Agent, or Firm*—McGlew and Tuttle

[57] ABSTRACT

In an electronic musical instrument, note frequency data corresponding to a plurality of temperaments are prestored and are selectively read out in accordance with a selected one of the temperaments, generating a note frequency corresponding thereto. Further, a plurality of note frequency data corresponding to each transposition operation for each temperament and selectively read out in accordance with a selected temperament and the transposition operation, thereby generating a note frequency corresponding thereto. Thus the temperament selection and the transposition operation can be performed with satisfactory stability and high frequency accuracy.

1 Claim, 6 Drawing Figures

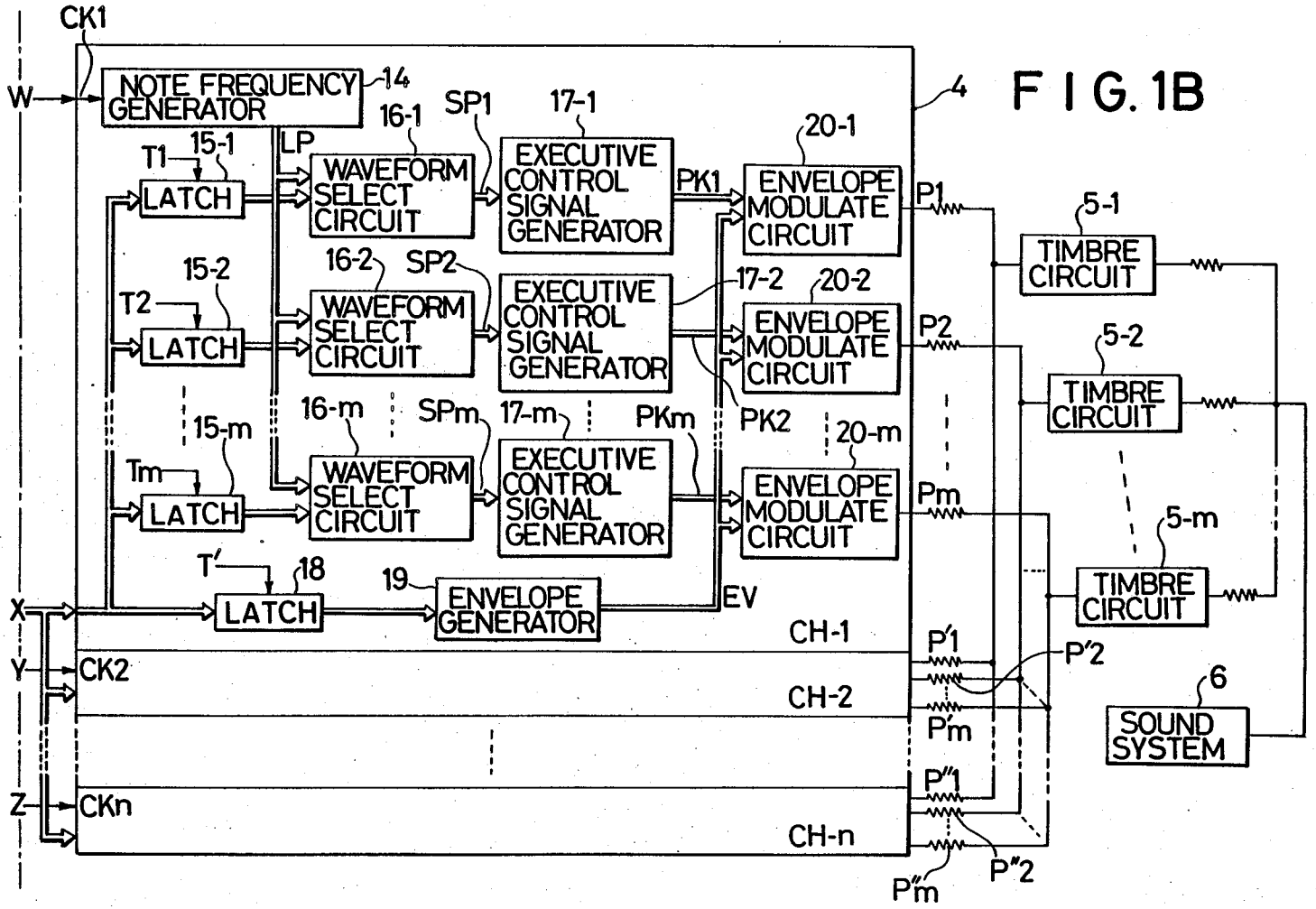
FIG. 1B
4
5-1
TIMBRE CIRCUIT
5-2
TIMBRE CIRCUIT
5-m
TIMBRE CIRCUIT
6
SOUND SYSTEM
P1
P2
Pm
P'1
P'm
P'2
P''1
P''m
P''2
20-1
ENVELOPE MODULATE CIRCUIT
20-2
ENVELOPE MODULATE CIRCUIT
20-m
ENVELOPE MODULATE CIRCUIT
CH-1
CH-2
CH-n
PK1
17-2
PK2
PKm
EV
17-1
EXECUTIVE CONTROL SIGNAL GENERATOR
EXECUTIVE CONTROL SIGNAL GENERATOR
17-m
EXECUTIVE CONTROL SIGNAL GENERATOR
ENVELOPE GENERATOR
SP1
SP2
SPm
14
16-1
WAVEFORM SELECT CIRCUIT
16-2
WAVEFORM SELECT CIRCUIT
16-m
WAVEFORM SELECT CIRCUIT
19
NOTE FREQUENCY GENERATOR
LP
18
15-1
LATCH
15-2
LATCH
15-m
LATCH
LATCH
T1
T2
Tm
T'
CK1
CK2
CKn
W
X
Y
Z

ELECTRIC MUSICAL INSTRUMENT

BACKGROUND OF THE INVENTION

1. Field of the Invention

The present invention relates to an electronic musical instrument adapted for digital control of the temperament of note frequencies and a transposition operation.

2. Description of the Prior Art

Heretofore, note frequencies of electronic musical instruments have been set on the basis of a temperament called an equal temperament. With the equal temperament, musical intervals are each formed by one of 12 "semitones" of the same frequency ratio into which an "octave" having a frequency ratio of 1:2 is divided equally.

As a method of obtaining note frequencies of the equal temperament, there has been well known, for example, a so-called "top octave" system according to which 12 standard toned are generated by dividing a sufficiently high main clock frequency into frequencies which approximately form musical intervals of the equal temperament and then octave relations are generated by the use of a plurality of $\frac{1}{2}$ frequency dividers.

On the other hand, since classical musical instruments of the Baroque era, in particular, employed such classical temperaments as a pure temperament, a Pythagorean temperament, a meantone temperament and so forth, there have also been proposed methods of generating note frequencies of such classical temperaments for electronic musical instruments. For instance, 12 standard tones of the pure temperament are produced by frequency dividers of frequency dividing ratios corresponding to the musical intervals of the pure temperament and then octave relations are produced by the same frequency division as in the "top octave" system. Further, there has been proposed a standard 12-tone generator including a complex combination of $\frac{1}{2}$ and $\frac{1}{3}$ frequency dividers, noting that the Pythagorean temperament uses, as standard tones, purely perfect fifths having a frequency ratio of 3:2.

With these conventional electronic musical instruments, however, the temperament used is determined through the use of a complex circuit arrangement, and for switching the temperament, for example, between the pure and the equal temperament, individual temperament generators are needed; namely, they are defective in that the temperament system cannot easily be changed and that the circuit arrangement is enormous.

Moreover, even if such electronic musical instruments are equipped with a transposition function, musical intervals relative to the transposed fundamental tone, in the classical temperaments, do not become equal to musical intervals having respective tones moved in parallel as in the equal temperament. To prevent this, a master clock frequency must be varied in accordance with the transposition, but it is difficult technically to change the sufficiently high master clock frequency stably and accurately for generating 12 tones. Therefore, they possess such a serious drawback that satisfactory accuracy of frequency and stability cannot be obtained.

SUMMARY OF THE INVENTION

It is therefore an object of the present invention to provide an electronic musical instrument in which note frequency data corresponding to a plurality of temperaments are prestored and selectively read out in accordance with a selected one of the temperaments to generate note frequencies, and a plurality of note frequency data corresponding to a transposition operation are prestored for the respective temperaments and selectively read out in accordance with the selected temperament and the transposition operation to generate note frequencies, thereby ensuring temperament selection and transposition operations with a sufficiently high degree of accuracy of frequency and with high stability.

To achieve the above object, the electronic musical instrument of the present invention is provided with storage means for storing note frequency data corresponding to a plurality of temperaments, a note frequency data selecting controller for suitably selecting the note frequency data from the storage means in accordance with a selected one of the temperaments and a musical tone generator for generating a musical waveform of a note frequency corresponding to the note frequency data selected by the note frequency data selecting controller, whereby note frequencies corresponding to the plurality of temperaments are produced. Further, note frequency data is prestored corresponding to the transposition operation for each temperament and the note frequency data for the temperament and the transposition operation is selected by the note frequency data selecting controller, thereby producing a note frequency corresponding to the temperament and the transposition operation.

BRIEF DESCRIPTION OF THE DRAWINGS

FIGS. 1A and 1B together are a block diagram illustrating an example of the arrangement of an embodiment of the electronic musical instrument of the present invention;

DESCRIPTION OF THE PREFERRED EMBODIMENTS

Figure 1A:
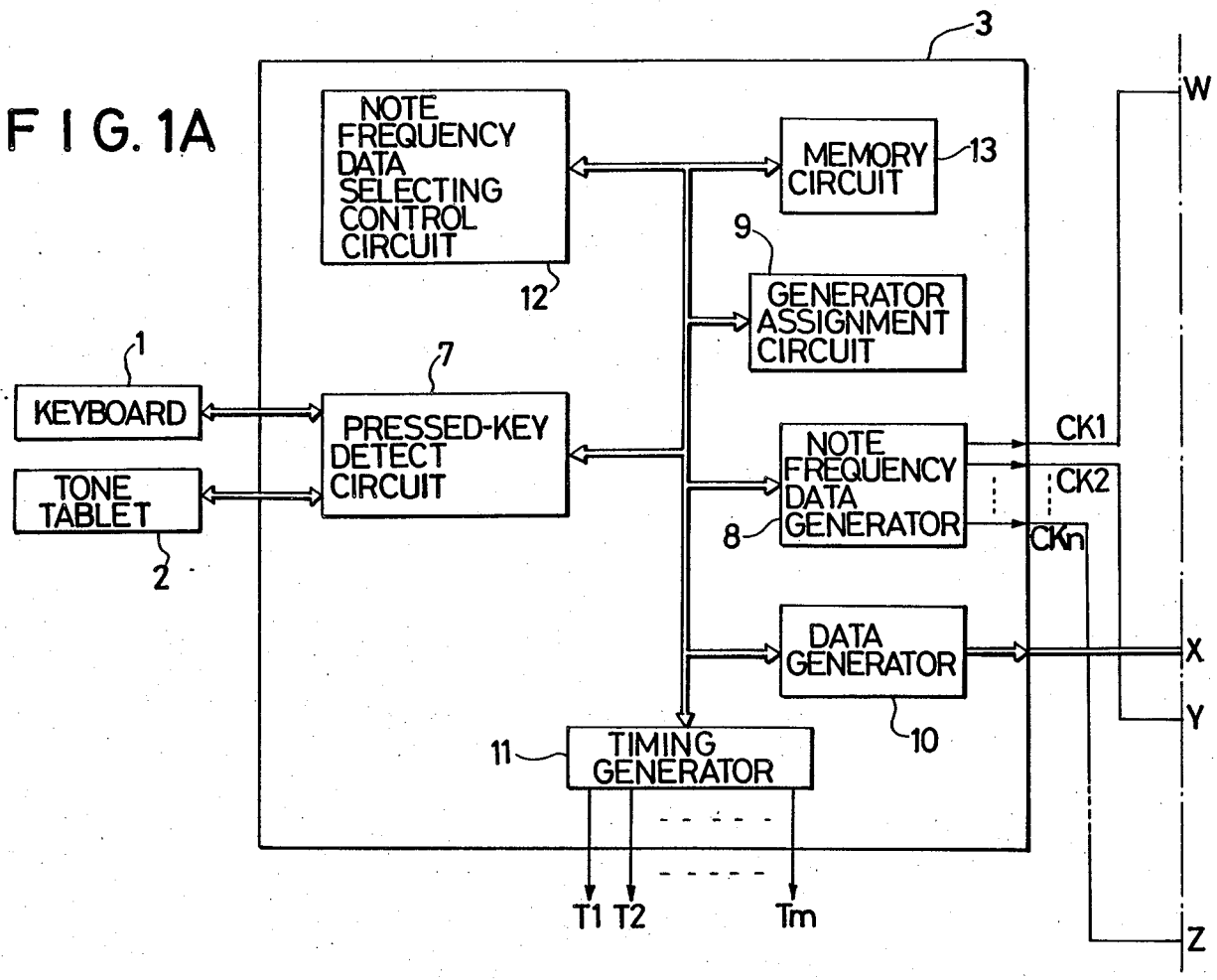

FIG. 1 illustrates in block form an embodiment of the electronic musical instrument of the present invention.

In FIG. 1, reference numeral 1 indicates a keyboard; 2 designates a tone tablet; 4 identifies a sound generator for producing a note frequency and a musical waveform; and 3 denotes a pressed-key detect and generator assignment circuit for supplying the sound generator 4 with necessary signals including temperament selection and transposition data.

In the pressed-key detect and generator assignment circuit 3, ON-OFF data and pitch data from the keyboard 1 and timbre data, temperament select data and transposition operation data from the tone tablet 2 are detected by a pressed-key detect circuit 7, and note frequency data corresponding to a plurality of temperaments and a transposition operation, fixed data for generating musical signals and data representing the operative state are loaded into a memory circuit 13. A note frequency data selecting control circuit 12 selects the note frequency data stored in the memory circuit 13 in accordance with the temperament being selected ahd the transposition operation. That is, note frequency data signals CK1, CK2, . . . and CKn (n being the number of tone generators) corresponding to note frequencies are selected in response to pressed-key date and delivered out through a note frequency data generator 8. In this case, a generator assignment circuit 9 assignes the note frequency data generator 8 to a tone generator in accordance with the pressed-key data. A data generator 10 provides data signals such as necessary keyboard ON-OFF data, musical waveform data and envelope data to the sound generator 4 in accordance with the pressed-key data. A timing generator 11 generates latches pulses T1, T2, . . . so that latches 15-1, 15-2, . . . 15-m, . . . of tone generators CH1, CH2, . . . and CHn of the sound generator 4 accept the data signals from the date generator 10.

The output signals from the pressed-key detect and generator assignment circuit 3 are applied to the sound generator 4 which comprises the plurality of tone generators CH1, CH2, . . . and CHn of the same construction. A description will be given of the operations of the plurality of tone generators of the sound generator 4 in connection with the first tone generator CH1. In the first tone generator CH1, the note frequency data signal CK1 assigned to the tone generator CH1 and supplied from the note frequency data generator 8 is privided to a note frequency generator 14. On the other hand, the musical waveform data in the output signal from the data generator 10 is applied to the latches 15-1, 15-2, . . . and 15-m and latched therein by the latch pulses T1, T2, . . . and Tm from the timing generator 11. Waveform select circuits 16-1, 16-2, . . . and 16-m are supplied with an output signal LP from the note frequency generator 14 and the musical waveform data which are outputs from the latches 15-1, 15-2, . . . and 15-m and select parameters for generating musical waveform signals, and the parameters are provided as output signals SP1, SP2, . . . and SPm to signal generators 17-1, 17-2, . . . and 17-m, respectively. The signal generators 17-1, 17-2, . . . and 17-m produce musical waveform signals PK1, PK2, . . . and PKm based on the parameters. Further, the keyboard ON-OFF data and envelope data on attach, decay, sustain and release from the data generator 10 are supplied to a latch 18 and latched therein by a latch pulse T' from the timing signal generator 11. The output of the latch 18 is provided to an envelope generator 19, from which an envelope signal EV for amplitude modulating the musical waveform signals PKl, PK2, . . . and PKm is applied to each of envelope mudulate circuits 20-1, 20-2, . . . and 20-m. The output signals PK1, PK2, . . . and PKm from the signal generators 17-1, 17-2, . . . and 17-m are amplitude modulated by the envelope signal EV in the envelope mudulate circuits 20-1, 20-2, . . . and 20-m, the outputs of which are used as output signals P1, P2, . . . and Pm of the first tone generator CH1 of the sound generator 4.

The outputs P1, P2, . . . and Pm, P1', P2', . . . and Pm', P1'', P2'', . . . and Pm'' of the respective tone generators CH1, CH2, . . . and CHn of the sound generator 4 are suitably synthesized by resistors, and are provided to timbre circuits 5-1, 5-2, . . . and 5-m, each made up of a filter circuit, an "effect" circuit and so on, wherein they are each converted into a desired musical signal after being controlled in its harmonic characteristic of a tone waveform. The outputs of the timbre circuits 5-2, 5-2, . . . and 5-m are suitably synthesized by resistors and converted by a sound system 6 including an "effect" circuit and a speaker into a sound of the electronic musical instrument.

In the above the tone generators CH1, CH2, . . . and CHn are made independent so that, for example a programmable frequency divider is used as the note frequency generator 14 and the note frequency data CK1, CK2, . . . and CLn are supplied as its frequency dividing ratio data. However, the present invention is not limited specifically thereto, but, for instance, by forming the note frequency generator 14 through the use of an adder-accumulator which produces the note frequency data CK1, CK2, . . . and CKn as increment data, it is also possible to time-division multiplex the note frequency data CK1, CK2, . . . and CKn and to consolidate the tone generators of the sound generator 4 into one for a time-divided operation.

Figure 2:
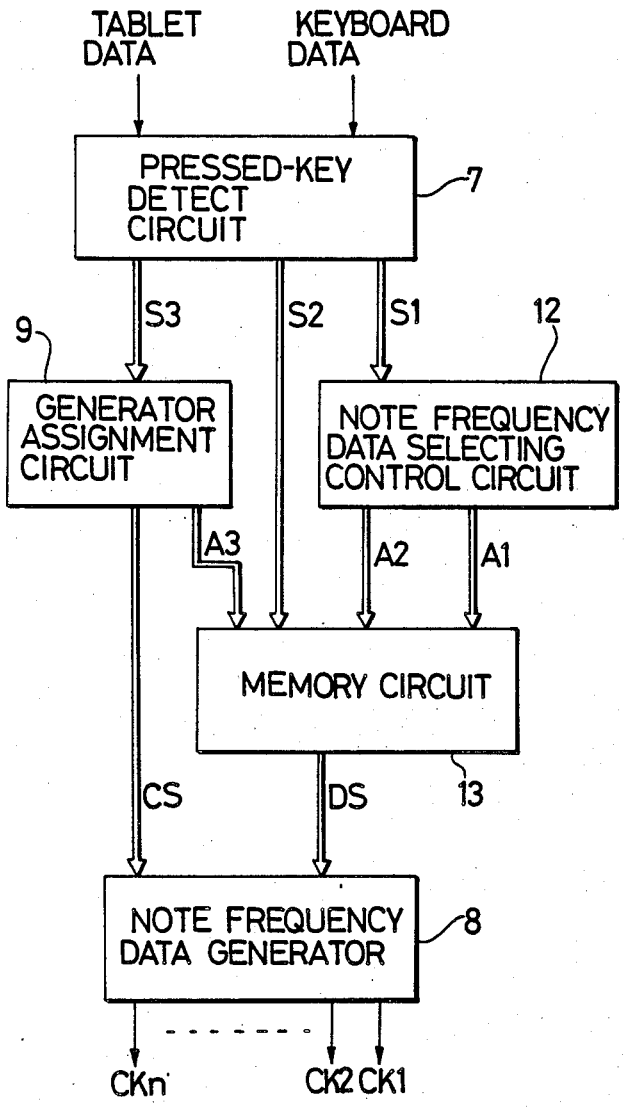
FIG. 2 is a block diagram illustrating in detail the principal part of the embodiment shown in FIG. 1.

FIG. 2 illustrates in detail the principal part of the embodiment, that is, the pressed-key detect circuit 7, the note frequency data selecting control circuit 12, the memory circuit 13, the generator assignment circuit 9 and the note frequency data generator 8 in the sound generator 4 shown in FIG. 1.

In FIG. 2, the pressed-key detect circuit 6 detects ON-OFF data and pitch data of the keyboard, timbre data, temperament selection data and transposition operation data of the tone tablet and generates an output signal S1 on the temperament selection and transposition operation, an output signal S2 on the pitch of the keyboard and an output signal S3 on the ON-OFF operation of the keyboard.

The note frequency selecting control circuit 12 receives the output signal S1 of the pressed-key detect circuit 7 and supplies the memory circuit 13 with address signals A1 and A2 corresponding to the temperament selection and the transposition operation. The generator assignment circuit 9 receives the output signal S3 of the pressed-key detect circuit 7 to perform a generator assignment operation and provides an address control signal A3 to the memory circuit 13 and a generator assignment control signal CS to the note frequency data generator 8. The memory circuit 13 accesses its stored note frequency data, using the input signals A1, A2 and S2 as address signals and the input signal A3 as an address control signal, and provides an output data signal DS to the note frequency data generator 8. The note frequency data generator 8 sends out the input data signal DS from the memory circuit 13 to any one of the tone generators CK1, CK2, . . . and CKn which is selected by the input control signal CS from the generator assignment circuit 9.

Figure 3:
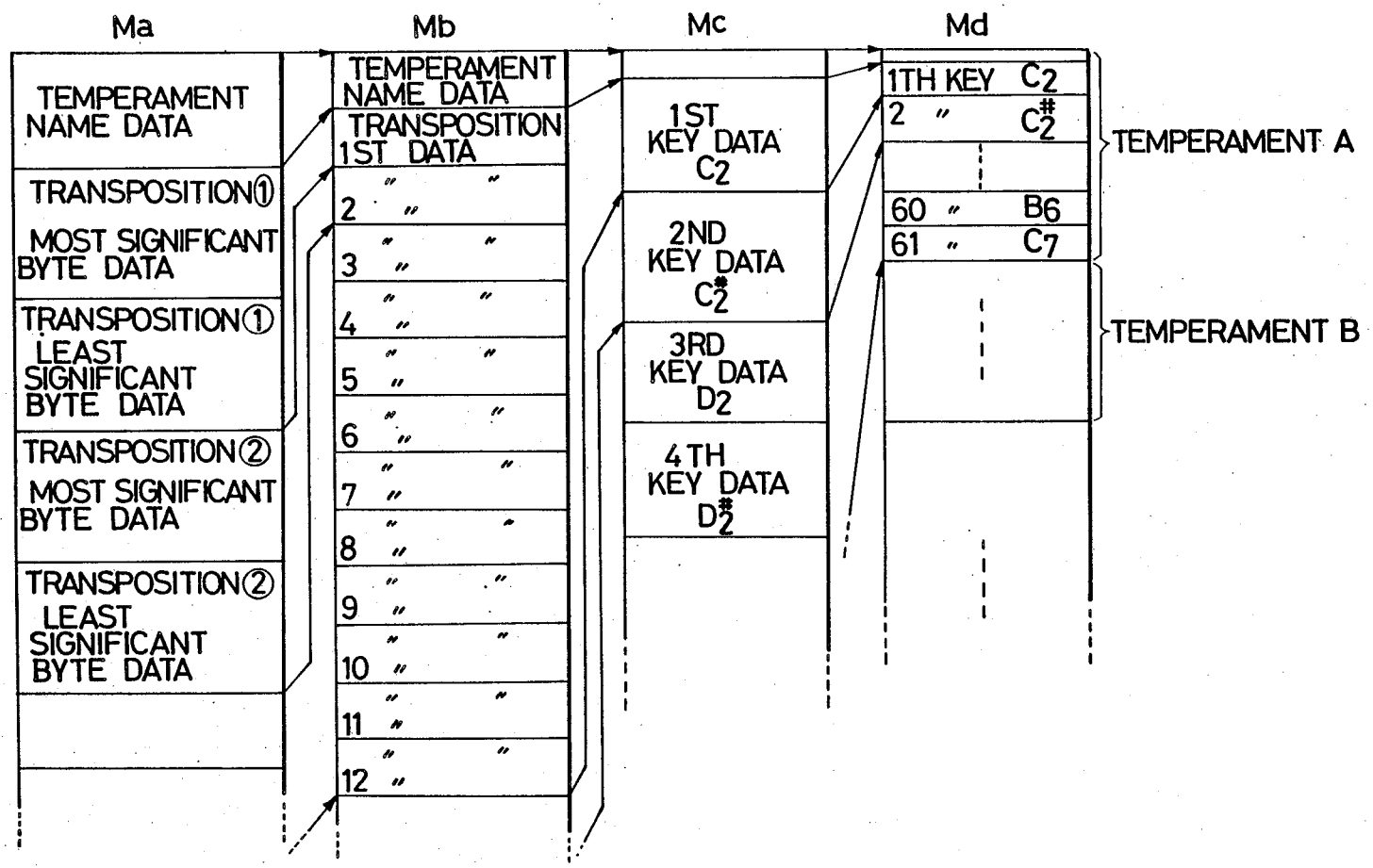
FIG. 3 is a diagram showing a memory arrangement explanatory of the operation of the example shown in FIG. 2.

A description will be given, with reference to FIG. 3, of an example of the above operation. In the memory circuit 13 there is stored the note frequency data, as shown in FIG. 3. That is, as indicated in the column Md, the memory is divided into a plurality of temperament blocks respectively assigned to temperaments A, B, . . . in a sequential order, and in order to switch one of the temperaments to another, a higher-order address corresponding to the leading address of each temperament is selected as the address signal A1. Further, as indicated in the columns Mc and Md, each temperament block is divided into data areas corresponding to the number of keys, for example, 61 keys, and the address signal S2 is selected in accordance with the pitch data of the keyboard. Moreover, as indicated in the columns Mb and Mc, each data area of one key is subdivided into data areas corresponding to, for example, 12 kinds of ranges of the transposition operation, and a lower-order address corresponding to a particular range of the transposition operation is selected as the address signal A2. Also it is effective to store note frequency data of required precision by dividing the data into, for instance, the most significant byte data and the least significant byte data, for each stage of the transposition operation and to store temperament name data at the beginning of each note frequency data for reference use, as shown in the columns Ma and Mb. The note frequency data DS selected by the memory circuit 13 is provided to the note frequency data generator 8, from which it is delivered by the control signal CS from the generator assignment circuit 9 to a required one of the tone generators. With the above operation, since delicate variations in the note frequency by the temperament switching and the transposition operation can be obtained by merely switching addresses for accessing the memory, it is possible to avoid lowering of the stability of operation and degradation of the frequency accuracy when changing a high master clock frequency. Further, by providing the note frequency data with a required number of bits, it is possible to obtain satisfactory frequency accuracy and to set the range of the transposition operation and the number of keys as required.

Figure 4:
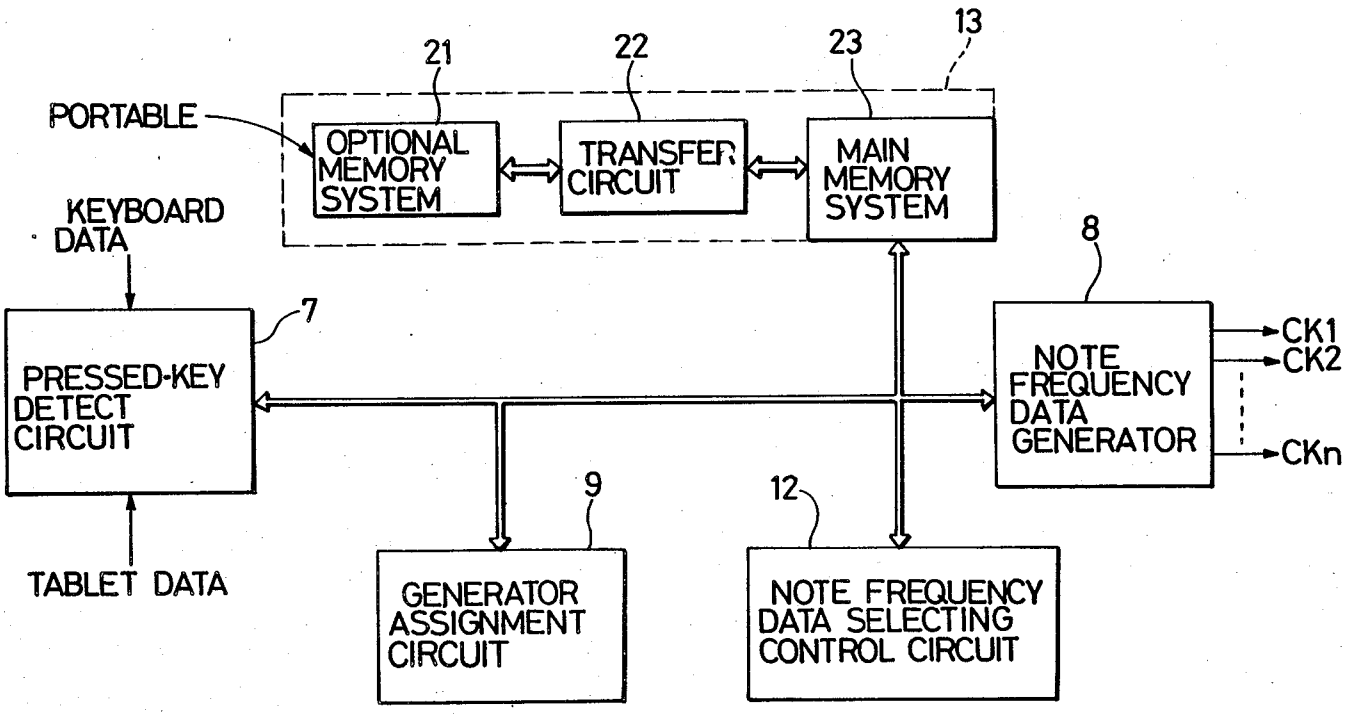
FIG. 4 is a block diagram illustrating another embodiment of the present invention.
Figure 5:
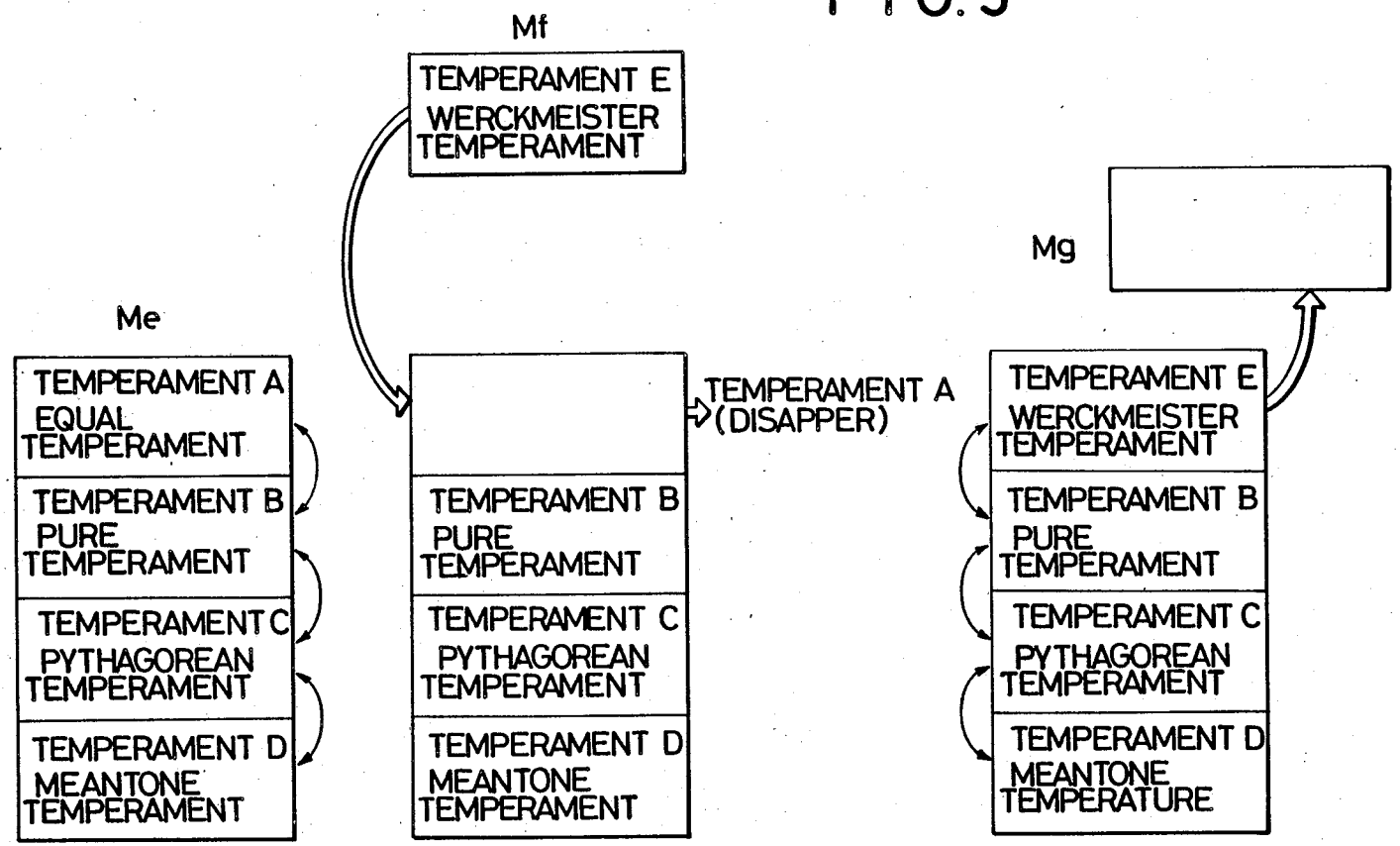
FIG. 5 is a diagram showing a memory arrangement explanatory of the operation of the embodiment depicted in FIG. 4.

FIG. 4 is a diagram explanatory of another embodiment of the present invention. In this embodiment, the memory circuit 13 is made up of a portable optional memory system 21, a transfer circuit 22 for reading out note frequency data therefrom for transfer and a main memory system 23 which forms a part of a storage area to store the note frequency data of the optional memory system 21. With this arrangement, it is possible to obtain an electronic musical instrument which permits easy setting and modification of the selection of temperaments stored in the main memory system 23. A description will be given, with reference to FIG. 5, of an example of the operation of this embodiment. The main memory system 23 is designed to have, for instance, four kinds of temperament blocks A, B, C and D for storing note frequency data corresponding to the equal, the pure, the Pythagorean and the meantone temperament, respectively. By connecting to the main memory system 23 the optional memory system 21 having stored therein note frequency data corresponding to the Werckmeister temperament and transferring the note frequency data via the transfer circuit 22 to the temperament block A of the main memory system 23, as shown in the column Mf, the note frequency data is stored in the main memory system 23, from which the Werckmeister temperament is selected by a temperament selecting operation in a moment. With the above operation, for example, when it is desired to judge a delicate difference between note frequencies of two kinds of temperaments by comparison with ears, it is necessary only to set the note frequency data of the temperaments in the optional memory system and any modifications need not be made to the electronic musical instrument itself. Moreover, a required one of the temperament blocks of the main memory system 23 can easily be transferred to the optional memory system 21, as shown in the column Mg, and this is very effective for studying a temperament separately of the electronic musical instrument itself.

As described above, according to the present invention, a plurality of note frequency data corresponding to various temperaments and a transposition operation are stored and are selected in accordance with a temperament selection and the transposition operation, by which a desired temperament can be set with sufficient stability and frequency accuracy. Further, the use of an optional memory system permits easy setting and change of temperaments. Accordingly, the present invention offers an electronic musical instrument which allows ease in setting temperaments and is satisfactory functions for performance and for study use.

It will be apparent that many modifications and variations may be effected without departing from the scope of the novel concepts of the present invention.

What is claimed is:

1. An electronic musical instrument which is capable of generating note frequencies corresponding to a plurality of kinds of temperaments and a transposition operation, comprising:

memory means for storing note frequency data corresponding to a plurality of temperaments by steps of more than one of each transposition operation;

a note frequency data selecting controller for selecting the note frequency data from the memory means in accordance with a selected one of the temperaments and the transposition operation; and a musical tone generator for generating, of the basis of the note frequency data selected by the note frequency data selecting controller, a musical waveform of a note frequency corresponding to the selected note frequency data;

the musical tone generator comprising means for generating a master clock frequency and a programmable frequency divider for dividing the master clock frequency, and wherein the note frequency data is frequency dividing ratio data for the programmable frequency data, the musical tone generator also comprising an adder-accumulator for generating an output pulse when the result of an add-accumulate operation overflows and means for periodically transferring increment data for the add-accumulate operation to the adder-accumulator, and wherein the note frequency data is the increment data for the adder-accumulator;

the memory means comprising optional memory means for storing the note frequency data individually and main memory means incorporated in the electronic musical instrument and connected via transfer means to the optional memory means, the optional memory means being detachable from the electronic musical instrument and portable.

* * * * *